US010428540B1

(12) United States Patent
Werner et al.

(10) Patent No.: US 10,428,540 B1
(45) Date of Patent: Oct. 1, 2019

(54) MODULAR COMMERCIAL STRUCTURE

(71) Applicants: Robert C. Werner, Phoenixville, PA (US); Wade K. Bennett, Wayne, PA (US)

(72) Inventors: Robert C. Werner, Phoenixville, PA (US); Wade K. Bennett, Wayne, PA (US)

(73) Assignee: Ardent Federal Credit Union, Philadelphia, PA (US)

( * ) Notice: Subject to any disclaimer, the term of this patent is extended or adjusted under 35 U.S.C. 154(b) by 0 days.

(21) Appl. No.: 16/037,469

(22) Filed: Jul. 17, 2018

(51) Int. Cl.
*E04H 1/00* (2006.01)
*E04B 1/348* (2006.01)

(52) U.S. Cl.
CPC ..... *E04H 1/005* (2013.01); *E04B 1/34861* (2013.01); *E04B 1/34846* (2013.01)

(58) Field of Classification Search
CPC . E04H 1/005; E04B 1/34861; E04B 1/34846; G07F 19/205
USPC ... 52/64, 67, 71, 36.1, 79.1, 79.5, 79.7, 234, 52/239, 578, 220.1, 220.2; 109/2, 9, 10, 109/13, 45, 78
See application file for complete search history.

(56) References Cited

U.S. PATENT DOCUMENTS 3,984,949 A * 10/1976 Wahlquist ..... E04B 1/3445 52/70
4,478,467 A * 10/1984 Tyndall ..... A47B 43/00 211/87.01
4,682,457 A 7/1987 Spencer
4,784,445 A 11/1988 Ott
5,036,779 A * 8/1991 Capraro ..... A47F 10/00 109/2
5,177,917 A 1/1993 del Castillo Von Haucke
5,222,445 A * 6/1993 Capraro ..... G07F 19/20 109/2
5,309,686 A 5/1994 Underwood et al.
5,406,760 A 4/1995 Edwards
5,426,900 A 6/1995 Springer
5,584,546 A 12/1996 Gurin et al.
5,615,623 A * 4/1997 Capraro, Jr. ..... G07F 19/20 109/2
5,687,513 A 11/1997 Baloga et al.
5,803,562 A 9/1998 Jacobs et al.
5,964,065 A * 10/1999 Migurski ..... E04H 3/08 52/64

(Continued)

*Primary Examiner* — Brent W Herring
(74) *Attorney, Agent, or Firm* — Bryan W. Bockhop; Bockhop Intellectual Property Law, LLC

(57) ABSTRACT

A modular commercial structure for use on a floor in an area having an electric power source coupled thereto includes a first exterior module, a second exterior module, an interior module, a conveyance mechanism and a distribution system. The first exterior module, the second exterior module and the interior module each defines an interior space therein. The conveyance mechanism selectively facilitates movement the modules so that the modular commercial structure has a first configuration in which the modules are brought together to prevent access to the interior spaces and so that the modular commercial structure has a second configuration in which the modules are spaced apart sufficiently to provide access to the interior spaces therein. The distribution system distributes electric power to the electrical wiring system of each module.

29 Claims, 3 Drawing Sheets

(56) References Cited

U.S. PATENT DOCUMENTS

| | | | | |
|---|---|---|---|---|
| 6,070,372 | A * | 6/2000 | Norman | E04B 1/3444 52/36.2 |
| 6,248,014 | B1 | 6/2001 | Collier | |
| 6,405,491 | B1 | 6/2002 | Gallant | |
| 7,374,258 | B2 | 5/2008 | Bowron | |
| 8,695,284 | B2 * | 4/2014 | Ho | E04H 1/125 52/64 |
| 8,720,125 | B2 * | 5/2014 | Andretich | B60P 3/00 52/79.5 |
| 9,022,414 | B2 * | 5/2015 | Bell | B62B 3/002 186/57 |
| 2002/0194792 | A1 | 12/2002 | Feldpausch et al. | |
| 2004/0003545 | A1 | 1/2004 | Gillespie | |
| 2005/0016081 | A1 | 1/2005 | Gomree et al. | |
| 2005/0160682 | A1 * | 7/2005 | Quadrio | B65D 88/005 52/67 |
| 2005/0279035 | A1 | 12/2005 | Donovan | |
| 2011/0179721 | A1 | 7/2011 | Barry et al. | |

* cited by examiner

MODULAR COMMERCIAL STRUCTURE

BACKGROUND OF THE INVENTION

1. Field of the Invention

The present invention relates to modular structures and, more specifically, to a modular structure configured for commercial activity.

2. Description of the Related Art

The traditional branch location for many financial institutions—such as credit unions, banks and the like—have typically been in dedicated buildings. In metropolitan areas, some such institutions rent space in the lobbies of office buildings as branch location. In metropolitan areas, many institutions will open branch locations in the lobbies of large office buildings. However, rental of lobby space in metropolitan areas has become increasingly expensive.

Due to the ability for customers to execute online transactions, full size financial branch locations are not always necessary. Many routine transactions are now executed online and customers can usually acquire small amounts of cash from automatic teller machines. Nonetheless, there are still many functions that require (or with which customers prefer) face-to-face interaction with institution officers. Such functions include: meetings with bank or loan officers, setting up new accounts, making cash deposits, etc. While institutions want to minimize the costs associated with operating branch locations, they still need such locations to execute these functions.

Many institutions operate several locations distributed throughout a given area—often more than is actually required to meet immediate customer need—for increased customer convenience and increased visibility to the public. While the customers of a financial institution would prefer many branch locations distributed throughout a city, operating costs increase substantially as more branch locations are opened. As a result, financial institutions limit the number of branch locations in order to control costs.

Therefore, there is a need for a commercial structure that allows an institution to operate many dispersed branch offices at a reduced cost.

SUMMARY OF THE INVENTION

The disadvantages of the prior art are overcome by the present invention which, in one aspect, is a modular commercial structure for use on a floor in an area having an electric power source coupled thereto. The modular commercial structure includes a first exterior module, a second exterior module, at least one interior module, a conveyance mechanism and a distribution system. The first exterior module defines an interior space therein. The first exterior module has a top side, a bottom side, a front side, an opposite back side, an interior elongated side and an opposite exterior elongated side. The interior elongated side defines an opening configured to allow access to the interior space. The first exterior module includes an electrical wiring system. A first adaptation for performance of a first predefined human activity is disposed in the interior space of the first exterior module. The second exterior module defines an interior space therein. The second exterior module has a top side, a bottom side, a front side, an opposite back side, an interior elongated side and an opposite exterior elongated side. The interior elongated side defines an opening configured to allow access to the interior space. The second exterior module includes an electrical wiring system. A second adaptation for performance of a second predefined human activity is disposed in the interior space of the second exterior module. The at least one interior module is disposed between the first exterior module and the second exterior module, and defines an interior space therein. The at least one interior module has a top side, a bottom side, a front side, an opposite back side, a first elongated side and an opposite second elongated side, at least one of the first elongated side and the second elongated side defining an opening configured to allow access to the interior space. The at least one interior module includes an electrical wiring system. A third adaptation for performance of a third predefined human activity is disposed in the interior space of the at least one interior module. The conveyance mechanism is in communication with the first exterior module, the second exterior module and the at least one interior module. The conveyance mechanism selectively facilitates movement of at least two of the first exterior module, the second exterior module and the at least one interior module so that the modular commercial structure has a first configuration in which the first exterior module, the second exterior module and the at least one interior module are brought together to prevent access to the interior spaces therein and so that the modular commercial structure has a second configuration in which the first exterior module, the second exterior module and the at least one interior module are spaced apart sufficiently to provide access to the interior spaces therein. The distribution system receives power from the electric power source and distributes electric power to the electrical wiring system of each of the first exterior module, the second exterior module and the interior module while the modular commercial structure is in either the first configuration or the second configuration.

In another aspect, the invention is a financial institution unit for use on a floor in an area having an electric power source coupled thereto that includes a first exterior module, a second exterior module, an interior module, a conveyance mechanism, a distribution system and an automatic teller machine. The first exterior module defines an interior space therein. The first exterior module has a top side, a bottom side, a front side, an opposite back side, an interior elongated side and an opposite exterior elongated side. The interior elongated side defines an opening configured to allow access to the interior space. The first exterior module includes an electrical wiring system. Consultant office furnishings are disposed in the interior space of the first exterior module. The second exterior module defines an interior space therein. The second exterior module has a top side, a bottom side, a front side, an opposite back side, an interior elongated side and an opposite exterior elongated side. The interior elongated side defines an opening configured to allow access to the interior space. The second exterior module includes an electrical wiring system. Teller office furnishings are disposed in the interior space of the second exterior module. The interior module is disposed between the first exterior module and the second exterior module, and defines an interior space therein. The interior module has a top side, a bottom side, a front side, an opposite back side, a first elongated side and an opposite second elongated side. At least one of the first elongated side and the second elongated side defines an opening configured to allow access to the interior space. The interior module includes an electrical wiring system. An adaptation for performance of a predefined human activity is disposed in the interior space of the interior module. The conveyance mechanism is in communication with the first exterior module, the second exterior module and the interior module. The conveyance mechanism selectively facilitates movement of at least two of the first exterior module, the second exterior module and the interior module so that the modular commercial structure has a first configuration in which the first exterior module, the second exterior module and the interior module are brought together to prevent access to the interior spaces therein and so that the modular commercial structure has a second configuration in which the first exterior module, the second exterior module and the interior module are spaced apart sufficiently to provide access to the interior spaces therein. The conveyance mechanism includes at least two parallel tracks embedded in the floor and at least two pairs of aligned rollers affixed to the bottom sides of at least two of the first exterior module, the second exterior module and the interior module so that the bottom side includes pairs of aligned rollers engaged in each of the two parallel tracks. The distribution system receives power from the electric power source and distributes electric power to the electrical wiring system of each of the first exterior module, the second exterior module and the interior module while the modular commercial structure is in either the first configuration or the second configuration. The automatic teller machine is secured to a selected one of the front side and the back side of the at least one of the exterior modules and the interior module and facing outwardly therefrom so as to provide access thereto while the modular commercial structure is in either the first configuration or the second configuration.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
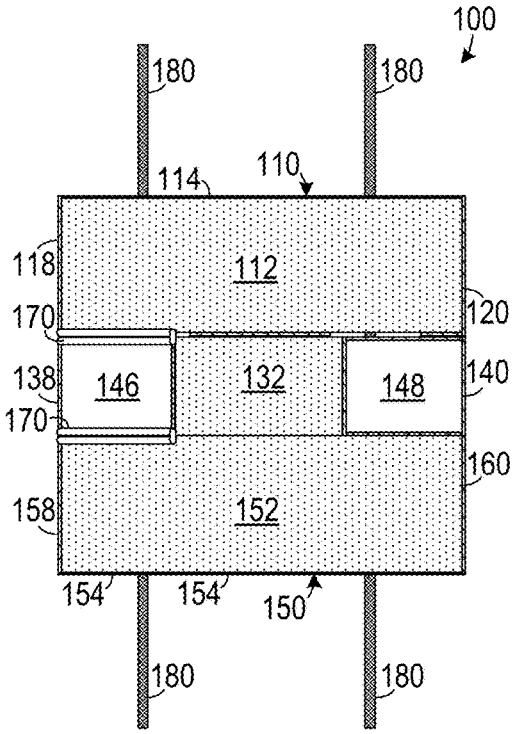
FIG. 1A is a top plan schematic view of a modular commercial structure in a first configuration.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1B:
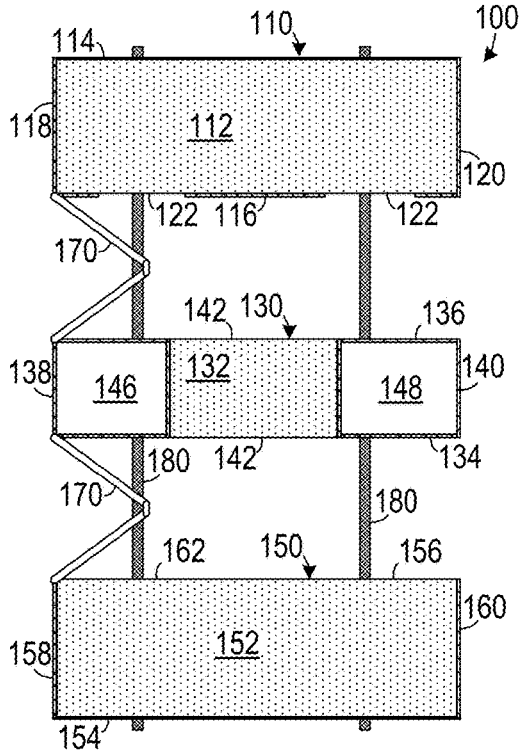
FIG. 1B is a top plan schematic view of the modular commercial structure shown in FIG. 1A in a second configuration.
Figure 2A:
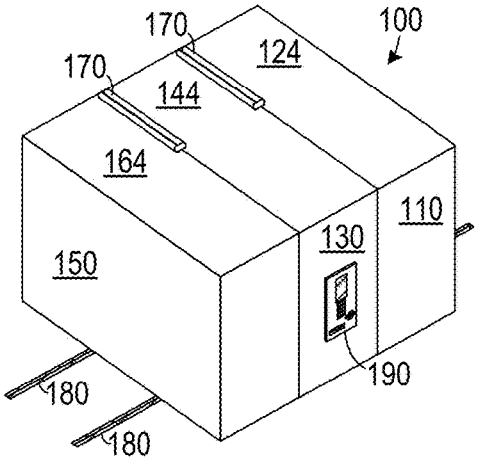
FIG. 2A is a perspective view of a modular commercial structure in the first configuration.
Figure 2B:
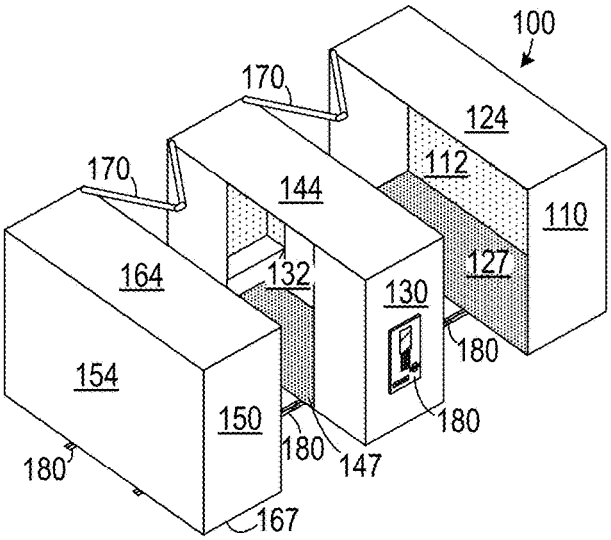
FIG. 2B is a perspective view of the modular commercial structure shown in FIG. 2A in the second configuration.

As shown in FIGS. 1A, 1B, 2A and 2B, one embodiment of a modular commercial structure 100 includes a first exterior module 110, an interior module 130 and a second exterior module 150 that are all mounted on a conveyance, such as a pair of embedded parallel tracks 180 so that the modules can be easily moved together into a first configuration (as shown in FIGS. 1A and 2A) or that can be easily moved apart into a second configuration (as shown in FIGS. 1B and 2B). The second configuration is typically employed during business hours and the first configuration is typically employed after business hours. A locking mechanism (not shown) can be used to keep the structure 100 closed and to prevent access after business hours.

The first exterior module 110 has an interior space therein 112 and includes a top side 124, a bottom side 127, a front side 118, an opposite back side 120, an interior elongated side 116 and an opposite exterior elongated side 114. The interior elongated side 116 has an opening 122 that allows access to the interior space 112. The second exterior module 150 has an interior space therein 152 and has a top side 164, a bottom side 167, a front side 158, an opposite back side 160, an interior elongated side 156 and an opposite exterior elongated side 154. The interior elongated side 156 has an opening 162 that allows access to the interior space 152. The interior module 130 (in some embodiments, there is a plurality of interior modules), is between the first exterior module 110 and the second exterior module 150. It has a passage 132 passing therethrough. It also has a top side 144, a bottom side 147, a front side 138, an opposite back side 140, a first elongated side 136 and an opposite second elongated side 134. The first elongated side 136 and the second elongated side 134 each define an opening 142 configured to allow access to the passage 132. The interior module 130 can also include a storage closet 146 and a space 148 for accommodating such things as an automatic teller machine 190. A distribution system, that includes a plurality of conduits 170, receives power from an electric power source (e.g., a floor-mounted electrical power source or a wall-mounted electrical power source) and that distributes electric power to each of the modules. The distribution system can also distribute data lines, telephone lines, cable television lines and the like.

Figure 3:
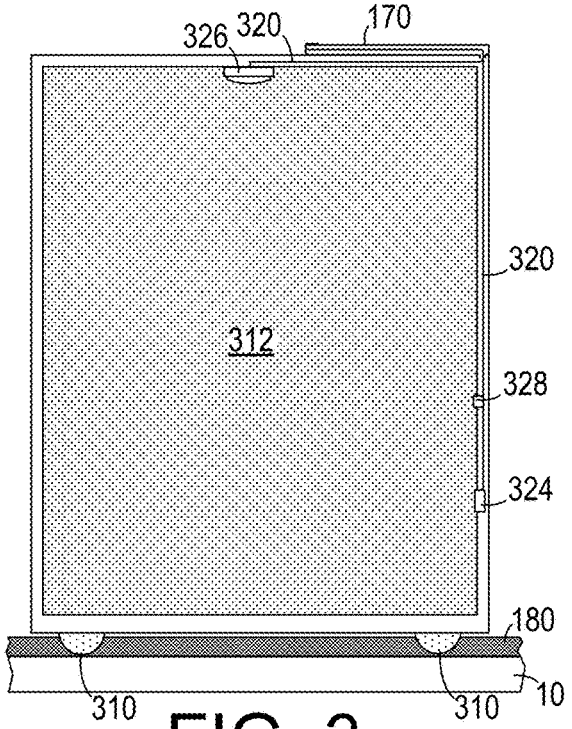
FIG. 3 is an elevational schematic view of a modular commercial structure.

As shown in FIG. 3, each module 312 (a generalized module is shown) has two pairs of rollers 310, such as wheels, that are spaced apart so that each pair of rollers 310 fits into a different one of the tracks 180, which in one embodiment are embedded in the floor 10. In other embodiments, the tracks 180 can be affixed on top of the floor 10.

Figure 4A:
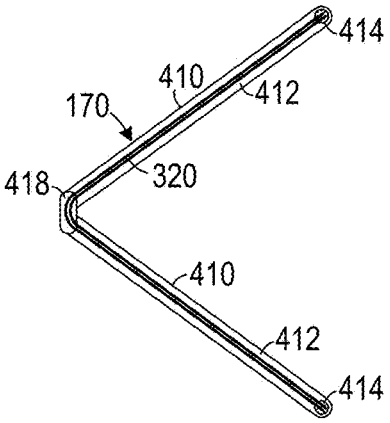
FIG. 4A is a top plan schematic view of a conduit used in a distribution system.
Figure 4B:
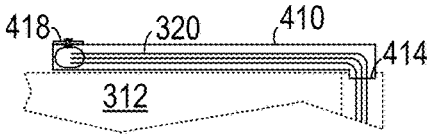
FIG. 4B is side elevational schematic view an arm used as part of a conduit.

Each module 312 also includes an electrical wiring system 320, which provides power to such items as lighting fixtures 326, switches 328 and power outlets 324. The wiring systems 320 of the different modules 312 are in communication with each other through the distribution system conduits 170. As shown in FIGS. 4A and 4B, each distribution conduit includes two scissor arms 410 that are each coupled to a different module at a proximal end 414 and coupled together at a distal end by a connector 418. Each arm 410 defines a channel 412 through which wires 320 pass. The wires can include electrical wires, data wires, telephone wires, cable-tv wires and the like. In an alternate embodiment, distribution of power and data is accomplished from the undersides of the modules. In another alternate embodiment, distribution is from power and data sources from the ceiling of the building in which the structure is disposed.

Figure 5:
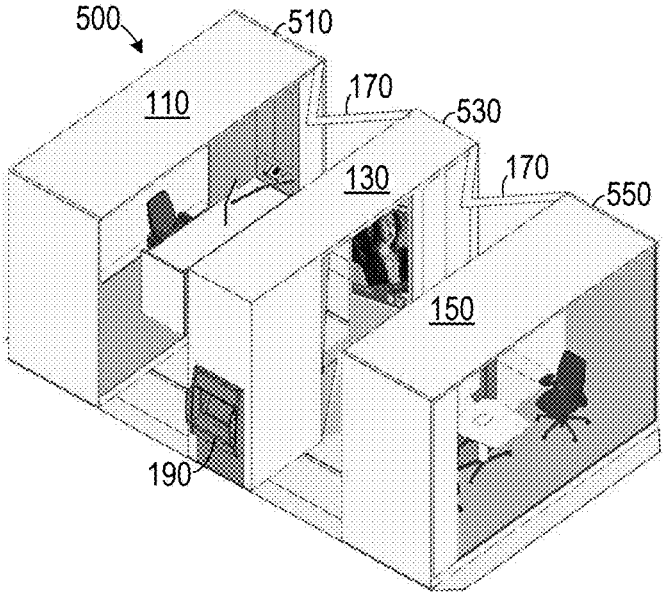
FIG. 5 is a perspective view of a modular commercial structure configured as a credit union.

In one embodiment, as shown in FIG. 5, a modular commercial structure of the type disclosed can be configured as a credit union branch office 500. In such an embodiment, one module 510 can be adapted to include teller office furnishings, one module 550 can be adapted to include consultant office furnishings and one module 530 can be configured as a customer convenience area. The modular commercial structure disclosed above can be configured as many different types of financial institution unit types, including: a credit union branch; a bank branch; a savings and loan branch; an insurance agency branch; a stock brokerage branch; a mobile field office, and the like.

Figure 6:
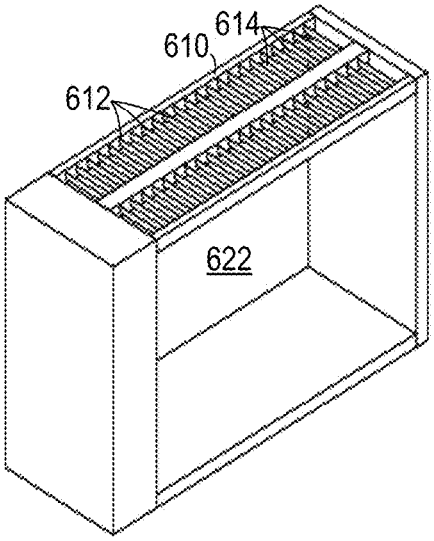
FIG. 6 is a perspective view of a module with a slatted top side.

In one embodiment, as shown in FIG. 6, some or all of the modules can be fitted with a slatted ceiling 610, which includes a plurality of slats 612 that define openings 614 to the interior space 622. This embodiment allows the modules to receive ambient light and can give the structure a more open feeling.

Figure 7:
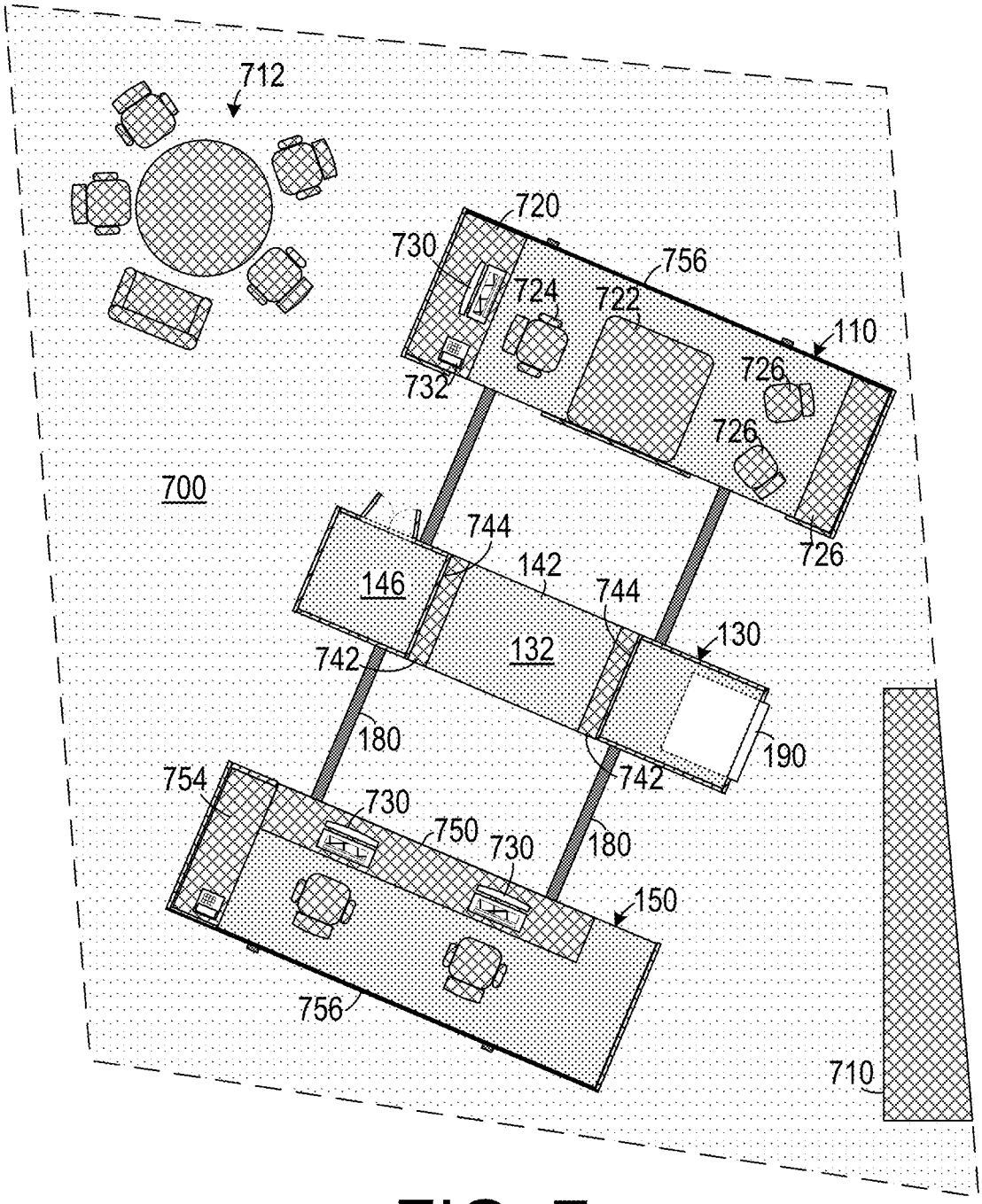
FIG. 7 is a top plan schematic view of a modular commercial structure disposed in a lobby area of an office building.

As shown in FIG. 7, one embodiment can be installed in the lobby area 700 of a large commercial building. Such a lobby area 700 could include, for example, general seating 712 and a reception desk 710. This particular embodiment is configured as a credit union branch, in which the first exterior module 110 is configured as a consultant office 710 with a desk 720 with a telephone 732 and a computer 730, an office chair 724 a work surface 722 such as a table, a couple of task chairs 726 and a credenza 726. The interior module 130 can have counters 742 disposed in the passageway 132 which can be used by customers for filling out deposit slips and the like. Walls along the passageway 132 can be used for posting information, advertising posters and even a flat panel screen. A storage closet 146 can be provided for storage of supplies and a safe. The second exterior module 150 could be configured as a teller office, which includes a teller counter 750 and a teller work surface 754.

In some embodiments, one or more of the modules can include a side of which at least a portion is a transparent (or at least translucent) wall 756, which gives the structure a more open effect. Such a transparent wall 756 would preferably include a material such as a security glass, a polycarbonate or the like, that would provide the desired level of transparency while still being hard to break so as to provide both durability and security. In addition, the modules can be fitted with whiteboards and magnetic boards, as needed.

Signage and advertising can be printed or applied to the exteriors of the modules. Flat panel displays can also be affixed to the exteriors of the modules to provide advertising and real time information. For example, in the credit union embodiment such displays could show current mortgage rates and in a stock brokerage embodiment such displays could show current stock quotes, etc.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A modular commercial structure for use on a floor in an area having an electric power source coupled thereto, the modular commercial structure comprising:

(a) a first exterior module defining an interior space therein, the first exterior module having a top side, a bottom side, a front side, an opposite back side, an interior elongated side and an opposite exterior elongated side, the interior elongated side defining an opening configured to allow access to the interior space, the first exterior module including an electrical wiring system, a first adaptation for performance of a first predefined human activity disposed in the interior space of the first exterior module;

(b) a second exterior module defining an interior space therein, the second exterior module having a top side, a bottom side, a front side, an opposite back side, an interior elongated side and an opposite exterior elongated side, the interior elongated side defining an opening configured to allow access to the interior space, the second exterior module including an electrical wiring system, a second adaptation for performance of a second predefined human activity disposed in the interior space of the second exterior module;

(c) at least one interior module, disposed between the first exterior module and the second exterior module, defining an passage therethrough, the at least one interior module having a top side, a bottom side, a front side, an opposite back side, a first elongated side and an opposite second elongated side, at least one of the first elongated side and the second elongated side defining an opening configured to allow access to the interior space, the at least one interior module including an electrical wiring system, a third adaptation for performance of a third predefined human activity disposed in the interior space of the at least one interior module;

(d) a conveyance mechanism in communication with the first exterior module, the second exterior module and the at least one interior module that selectively facilitates movement of at least two of the first exterior module, the second exterior module and the at least one interior module so that the modular commercial structure has a first configuration in which the first exterior module, the second exterior module and the at least one interior module are brought together to prevent access to the interior spaces therein and so that the modular commercial structure has a second configuration in which the first exterior module, the second exterior module and the at least one interior module are spaced apart sufficiently to provide access to the interior spaces therein;

(e) a distribution system that receives power from the electric power source and that distributes electric power to the electrical wiring system of each of the first exterior module, the second exterior module and the interior module while the modular commercial structure is in either the first configuration or the second configuration;

(f) at least two parallel tracks affixed to the floor; and (g) at least two pairs of aligned rollers affixed to the bottom sides of at least two of the first exterior module, the second exterior module and the interior module so that the bottom side includes pairs of aligned rollers engaged in each of the two parallel tracks.

2. The modular commercial structure of claim 1, wherein each of the two parallel tracks is embedded in the floor.

3. The modular commercial structure of claim 1, wherein the distribution system comprises:

(a) a first conduit, through which wires run, that couples the first exterior module to the interior module; and (b) a second conduit, through which wires run, that couples the second exterior module to the interior module.

4. The modular commercial structure of claim 3, wherein the first conduit and the second conduit each comprise:

(a) a first arm having a proximal end and an opposite distal end, and defining a channel therein through which the wires pass; and (b) a second arm a proximal end and an opposite distal end, and defining a channel therein through which the wires pass, wherein the proximal end of the first arm is coupled to a first one of the modules, the proximal end of the second arm is coupled to a different one of the modules and the distal end of the first arm is hingedly attached to the distal end of the second arm.

5. The modular commercial structure of claim 1, configured as a financial institution unit.

6. The modular commercial structure of claim 5, wherein the financial institution unit is selected from a list of financial institution unit types consisting of: a credit union branch; a bank branch; a savings and loan branch; an insurance agency branch; and a stock brokerage branch.

7. The modular commercial structure of claim 5, wherein the first adaptation comprises consultant office furnishings.

8. The modular commercial structure of claim 7, wherein the consultant office furnishings comprise:

(a) an office chair disposed within the interior space of the first exterior module;

(b) a work surface disposed along at least a portion of the interior elongated side of the first exterior module; and (c) a desk disposed along the back side of the first exterior module.

9. The modular commercial structure of claim 5, wherein the second adaptation comprises teller office furnishings.

10. The modular commercial structure of claim 9, wherein the teller office furnishings comprise a customer service counter running along a portion of the interior side of the second exterior module.

11. The modular commercial structure of claim 5, wherein the third adaptation comprises:

(a) a passageway passing through the interior space; and (b) at least one counter extending inwardly from a selected one of the front side and the back side into the passageway.

12. The modular commercial structure of claim 1, wherein the top side of at least one of the first exterior module, the second exterior module and the interior module comprises a slatted roof that defines openings to the interior space.

13. The modular commercial structure of claim 1, disposed inside of a building.

14. The modular commercial structure of claim 1, wherein the distribution system further distributes data lines.

15. A financial institution unit for use on a floor in an area having an electric power source coupled thereto, comprising:

(a) a first exterior module defining an interior space therein, the first exterior module having a top side, a bottom side, a front side, an opposite back side, an interior elongated side and an opposite exterior elongated side, the interior elongated side defining an opening configured to allow access to the interior space, the first exterior module including an electrical wiring system, consultant office furnishings being disposed in the interior space of the first exterior module;

(b) a second exterior module defining an interior space therein, the second exterior module having a top side, a bottom side, a front side, an opposite back side, an interior elongated side and an opposite exterior elongated side, the interior elongated side defining an opening configured to allow access to the interior space, the second exterior module including an electrical wiring system, teller office furnishings being disposed in the interior space of the second exterior module;

(c) an interior module, disposed between the first exterior module and the second exterior module, defining an interior space therein, the interior module having a top side, a bottom side, a front side, an opposite back side, a first elongated side and an opposite second elongated side, at least one of the first elongated side and the second elongated side defining an opening configured to allow access to the interior space, the interior module including an electrical wiring system, an adaptation for performance of a predefined human activity being disposed in the interior space of the interior module;

(d) a conveyance mechanism in communication with the first exterior module, the second exterior module and the interior module that selectively facilitates movement of at least two of the first exterior module, the second exterior module and the interior module so that the modular commercial structure has a first configuration in which the first exterior module, the second exterior module and the interior module are brought together to prevent access to the interior spaces therein and so that the modular commercial structure has a second configuration in which the first exterior module, the second exterior module and the interior module are spaced apart sufficiently to provide access to the interior spaces therein, the conveyance system including:

(i) at least two parallel tracks embedded in the floor; and (ii) at least two pairs of aligned rollers affixed to the bottom sides of at least two of the first exterior module, the second exterior module and the interior module so that the bottom side includes pairs of aligned rollers engaged in each of the two parallel tracks;

(e) a distribution system that receives power from the electric power source and that distributes electric power to the electrical wiring system of each of the first exterior module, the second exterior module and the interior module while the modular commercial structure is in either the first configuration or the second configuration; and (f) an automatic teller machine secured to a selected one of the front side and the back side of the at least one of the exterior modules and the interior module and facing outwardly therefrom so as to provide access thereto while the modular commercial structure is in either the first configuration or the second configuration.

16. The financial institution unit of claim 15, wherein the distribution system comprises:

(a) a first conduit through which wires run that couples the first exterior module to the interior module; and (b) a second conduit through which wires run that couples the second exterior module to the interior module, wherein the first conduit and the second conduit each comprise: a first arm having a proximal end and an opposite distal end, and defining a channel therein through which the wires pass; and a second arm a proximal end and an opposite distal end, and defining a channel therein through which the wires pass, wherein the proximal end of the first arm is coupled to a first one of the modules, the proximal end of the second arm is coupled to a different one of the modules and the distal end of the first arm is hingedly attached to the distal end of the second arm.

17. The financial institution unit of claim 15, wherein the consultant office furnishings comprise:

(a) an office chair disposed within the interior space of the first exterior module;

(b) a work surface disposed along at least a portion of the interior elongated side of the first exterior module; and (c) a desk disposed along the back side of the first exterior module; and wherein the teller office furnishings comprise a customer service counter running along a portion of the interior side of the second exterior module, and wherein the third adaptation comprises: a passageway passing through the interior space; and at least one counter extending inwardly from a selected one of the front side and the back side into the passageway.

18. The financial institution unit of claim 15, wherein a portion of at least one of the exterior elongated side of the first exterior module and the exterior elongated side of the second exterior module comprises a transparent wall.

19. The financial institution unit of claim 15, wherein the top side of at least one of the first exterior module, the second exterior module and the interior module comprises a slatted roof that defines openings to the interior space.

20. The financial institution unit of claim 15, wherein the distribution system further distributes data lines.

21. The financial institution unit of claim 15, wherein the financial institution unit is selected from a list of financial institution unit types consisting of: a credit union branch; a bank branch; a savings and loan branch; an insurance agency branch; and a stock brokerage branch.

22. A modular commercial structure for use on a floor in an area having an electric power source coupled thereto, the modular commercial structure comprising:

(a) a first exterior module defining an interior space therein, the first exterior module having a top side, a bottom side, a front side, an opposite back side, an interior elongated side and an opposite exterior elongated side, the interior elongated side defining an opening configured to allow access to the interior space, the first exterior module including an electrical wiring system, a first adaptation for performance of a first predefined human activity disposed in the interior space of the first exterior module;

(b) a second exterior module defining an interior space therein, the second exterior module having a top side, a bottom side, a front side, an opposite back side, an interior elongated side and an opposite exterior elongated side, the interior elongated side defining an opening configured to allow access to the interior space, the second exterior module including an electrical wiring system, a second adaptation for performance of a second predefined human activity disposed in the interior space of the second exterior module;

(c) at least one interior module, disposed between the first exterior module and the second exterior module, defining an passage therethrough, the at least one interior module having a top side, a bottom side, a front side, an opposite back side, a first elongated side and an opposite second elongated side, at least one of the first elongated side and the second elongated side defining an opening configured to allow access to the interior space, the at least one interior module including an electrical wiring system, a third adaptation for performance of a third predefined human activity disposed in the interior space of the at least one interior module;

(d) a conveyance mechanism in communication with the first exterior module, the second exterior module and the at least one interior module that selectively facilitates movement of at least two of the first exterior module, the second exterior module and the at least one interior module so that the modular commercial structure has a first configuration in which the first exterior module, the second exterior module and the at least one interior module are brought together to prevent access to the interior spaces therein and so that the modular commercial structure has a second configuration in which the first exterior module, the second exterior module and the at least one interior module are spaced apart sufficiently to provide access to the interior spaces therein;

(e) a distribution system that receives power from the electric power source and that distributes electric power to the electrical wiring system of each of the first exterior module, the second exterior module and the interior module while the modular commercial structure is in either the first configuration or the second configuration; and (f) an automatic teller machine secured to a selected one of the front side and the back side of the at least one of the exterior modules and the interior module and facing outwardly therefrom so as to provide access thereto while the modular commercial structure is in either the first configuration or the second configuration.

23. The modular commercial structure of claim 22, wherein the distribution system comprises:

(a) a first conduit, through which wires run, that couples the first exterior module to the interior module; and (b) a second conduit, through which wires run, that couples the second exterior module to the interior module.

24. The modular commercial structure of claim 23, wherein the first conduit and the second conduit each comprise:

(a) a first arm having a proximal end and an opposite distal end, and defining a channel therein through which the wires pass; and (b) a second arm a proximal end and an opposite distal end, and defining a channel therein through which the wires pass, wherein the proximal end of the first arm is coupled to a first one of the modules, the proximal end of the second arm is coupled to a different one of the modules and the distal end of the first arm is hingedly attached to the distal end of the second arm.

25. The modular commercial structure of claim 22, wherein a portion of at least one of the exterior elongated side of the first exterior module and the exterior elongated side of the second exterior module comprises a transparent wall.

26. A modular commercial structure for use on a floor in an area having an electric power source coupled thereto, the modular commercial structure comprising:

(a) a first exterior module defining an interior space therein, the first exterior module having a top side, a bottom side, a front side, an opposite back side, an interior elongated side and an opposite exterior elongated side, the interior elongated side defining an opening configured to allow access to the interior space, the first exterior module including an electrical wiring system, a first adaptation for performance of a first predefined human activity disposed in the interior space of the first exterior module;

(b) a second exterior module defining an interior space therein, the second exterior module having a top side, a bottom side, a front side, an opposite back side, an interior elongated side and an opposite exterior elongated side, the interior elongated side defining an opening configured to allow access to the interior space, the second exterior module including an electrical wiring system, a second adaptation for performance of a second predefined human activity disposed in the interior space of the second exterior module;

(c) at least one interior module, disposed between the first exterior module and the second exterior module, defining an passage therethrough, the at least one interior module having a top side, a bottom side, a front side, an opposite back side, a first elongated side and an opposite second elongated side, at least one of the first elongated side and the second elongated side defining an opening configured to allow access to the interior space, the at least one interior module including an electrical wiring system, a third adaptation for performance of a third predefined human activity disposed in the interior space of the at least one interior module;

(d) a conveyance mechanism in communication with the first exterior module, the second exterior module and the at least one interior module that selectively facilitates movement of at least two of the first exterior module, the second exterior module and the at least one interior module so that the modular commercial structure has a first configuration in which the first exterior module, the second exterior module and the at least one interior module are brought together to prevent access to the interior spaces therein and so that the modular commercial structure has a second configuration in which the first exterior module, the second exterior module and the at least one interior module are spaced apart sufficiently to provide access to the interior spaces therein; and (e) a distribution system that receives power from the electric power source and that distributes electric power to the electrical wiring system of each of the first exterior module, the second exterior module and the interior module while the modular commercial structure is in either the first configuration or the second configuration, wherein a portion of at least one of the exterior elongated side of the first exterior module and the exterior elongated side of the second exterior module comprises a transparent wall.

27. The modular commercial structure of claim 26, wherein the distribution system comprises:

(a) a first conduit, through which wires run, that couples the first exterior module to the interior module; and (b) a second conduit, through which wires run, that couples the second exterior module to the interior module.

28. The modular commercial structure of claim 27, wherein the first conduit and the second conduit each comprise:

(a) a first arm having a proximal end and an opposite distal end, and defining a channel therein through which the wires pass; and (b) a second arm a proximal end and an opposite distal end, and defining a channel therein through which the wires pass, wherein the proximal end of the first arm is coupled to a first one of the modules, the proximal end of the second arm is coupled to a different one of the modules and the distal end of the first arm is hingedly attached to the distal end of the second arm.

29. The modular commercial structure of claim 26, further comprising an automatic teller machine secured to a selected one of the front side and the back side of the at least one of the exterior modules and the interior module and facing outwardly therefrom so as to provide access thereto while the modular commercial structure is in either the first configuration or the second configuration.

* * * * *